US007935000B2

(12) United States Patent
Stites

(10) Patent No.: US 7,935,000 B2
(45) Date of Patent: May 3, 2011

(54) GOLF CLUBS AND GOLF CLUB HEADS

(75) Inventor: John T. Stites, Weatherford, TX (US)

(73) Assignee: Nike, Inc., Beaverton, OR (US)

( * ) Notice: Subject to any disclaimer, the term of this patent is extended or adjusted under 35 U.S.C. 154(b) by 126 days.

(21) Appl. No.: 12/416,735

(22) Filed: Apr. 1, 2009

(65) Prior Publication Data

US 2010/0255923 A1 Oct. 7, 2010

(51) Int. Cl.
*A63B 53/04* (2006.01)

(52) U.S. Cl. ..... 473/291; 473/350

(58) Field of Classification Search ..... 473/290–291, 473/350

See application file for complete search history.

(56) References Cited

U.S. PATENT DOCUMENTS 4,715,601 A * 12/1987 Lamanna ..... 473/291
4,919,430 A 4/1990 Antonious
5,014,993 A 5/1991 Antonious
5,046,733 A 9/1991 Antonious
5,290,032 A 3/1994 Fenton et al.
5,295,686 A * 3/1994 Lundberg ..... 473/291
5,306,008 A * 4/1994 Kinoshita ..... 473/242
5,328,184 A 7/1994 Antonious
5,401,021 A 3/1995 Allen
5,524,880 A * 6/1996 Kobayashi ..... 473/291
5,549,297 A 8/1996 Mahaffey
5,823,887 A * 10/1998 Mikame et al. ..... 473/290
6,015,354 A 1/2000 Ahn et al.
6,379,262 B1 4/2002 Boone
6,454,665 B2 9/2002 Antonious
7,235,023 B2 * 6/2007 Sugimoto ..... 473/291
2002/0082108 A1 * 6/2002 Peters et al. ..... 473/291
2004/0204263 A1 * 10/2004 Fagot et al. ..... 473/291
2005/0137024 A1 6/2005 Stites et al.
2007/0207878 A1 * 9/2007 Tavares et al. ..... 473/346

OTHER PUBLICATIONS

International Search Report and Written Opinion issued in corresponding PCT/US2010/029310; mailed Aug. 2, 2010.

* cited by examiner

*Primary Examiner* — Stephen L. Blau
(74) *Attorney, Agent, or Firm* — Banner & Witcoff, Ltd

(57) ABSTRACT

Golf club heads which include an iron type golf club head body including a ball striking face, a rear surface opposite the ball striking face (e.g., including a perimeter weighting member) and an indicator which indicates the location of the center of gravity of the golf club head body. Golf clubs including these club heads and methods of making such golf club and golf club heads also are provided.

8 Claims, 7 Drawing Sheets

GOLF CLUBS AND GOLF CLUB HEADS

FIELD OF THE DISCLOSURE

The present disclosure relates to golf clubs and golf club heads. Particular example aspects of this disclosure relate to golf clubs and golf club heads having indicators for indicating particular regions of the golf club head.

BACKGROUND

Golf is enjoyed by a wide variety of players—players of different genders and dramatically different ages and/or skill levels. Golf is somewhat unique in the sporting world in that such diverse collections of players can play together in golf events, even in direct competition with one another (e.g., using handicapped scoring, different tee boxes, in team formats, etc.), and still enjoy the golf outing or competition. These factors, together with the increased availability of golf programming on television (e.g., golf tournaments, golf news, golf history, and/or other golf programming) and the rise of well known golf superstars, at least in part, have increased golf's popularity in recent years, both in the United States and across the world.

Golfers at all skill levels seek to improve their performance, lower their golf scores, and reach that next performance "level." Manufacturers of all types of golf equipment have responded to these demands, and in recent years, the industry has witnessed dramatic changes and improvements in golf equipment. For example, a wide range of different golf ball models now are available, with balls designed to complement specific swing speeds and/or other player characteristics or preferences, e.g., with some balls designed to fly farther and/or straighter; some designed to provide higher or flatter trajectories; some designed to provide more spin, control, and/or feel (particularly around the greens); some designed for faster or slower swing speeds; etc. A host of swing and/or teaching aids also are available on the market that promise to help lower one's golf scores.

Being the sole instrument that sets a golf ball in motion during play, golf clubs also have been the subject of much technological research and advancement in recent years. For example, the market has seen dramatic changes and improvements in putter designs, golf club head designs, shafts, and grips in recent years. Additionally, other technological advancements have been made in an effort to better match the various elements and/or characteristics of the golf club and characteristics of a golf ball to a particular user's swing features or characteristics (e.g., club fitting technology, ball launch angle measurement technology, ball spin rates, etc.).

While the industry has witnessed dramatic changes and improvements to golf equipment in recent years, there is room in the art for further advances in golf club technology.

SUMMARY OF THE DISCLOSURE

The following presents a general summary of aspects of the disclosure in order to provide a basic understanding of the disclosure and various aspects of it. This summary is not intended to limit the scope of the disclosure in any way, but it simply provides a general overview and context for the more detailed description that follows.

Golf club heads according to at least some example aspects of this disclosure include: an iron-type golf club head body having a ball striking face and a rear surface opposite the ball striking face (e.g., including a perimeter weighting member extending rearward from the ball striking face and along at least a portion of a circumferential area of the golf club head body). Also, the golf club head body may include an indicator. Further, in accordance with at least some examples of this disclosure, the indicator may indicate the precise location of the center of gravity of the golf club head.

A set of golf club heads in accordance with at least some examples of this disclosure may include club head bodies that have varying centers of gravity depending on the particular club head body. In such golf club head bodies, the indicators may be positioned to indicate the location of the center of gravity for each respective club head body.

According to some aspects of this disclosure, the positioning of the indicator can be used to alter the center of the gravity of the club head body. For example, due to the indicator's weighting characteristics (weight, density, etc.), the position of the indicator with respect to the club head body will redistribute the weight of the golf club head body and thereby shift the club head body's center of gravity. Therefore, the indicator can be selectively positioned to control features of the club head's center of gravity.

Additional aspects of this disclosure relate to golf club structures that include golf club heads, e.g., of the types described above. Such golf club structures further may include one or more of: a shaft member attached to the club head (optionally via a separate hosel member or a hosel member provided as an integral part of one or more of the club head or shaft); a grip or handle member attached to the shaft member; additional weight members; etc.

Still additional aspects of this disclosure relate to methods for producing golf club heads and golf club structures, e.g., of the types described above. Such methods may include, for example: (a) providing a golf club head of the various types described above, e.g., by manufacturing or otherwise constructing the golf club head body, by obtaining the golf club head body from another source, etc.; and (b) engaging a shaft member with the golf club head. Other steps also may be included in these methods, such as engaging a grip member with the shaft member, club head body finishing steps, etc.

BRIEF DESCRIPTION OF THE DRAWINGS

The present disclosure is illustrated by way of example and not limited in the accompanying figures, in which like reference numerals indicate similar elements throughout, and in which.

Figure 1:
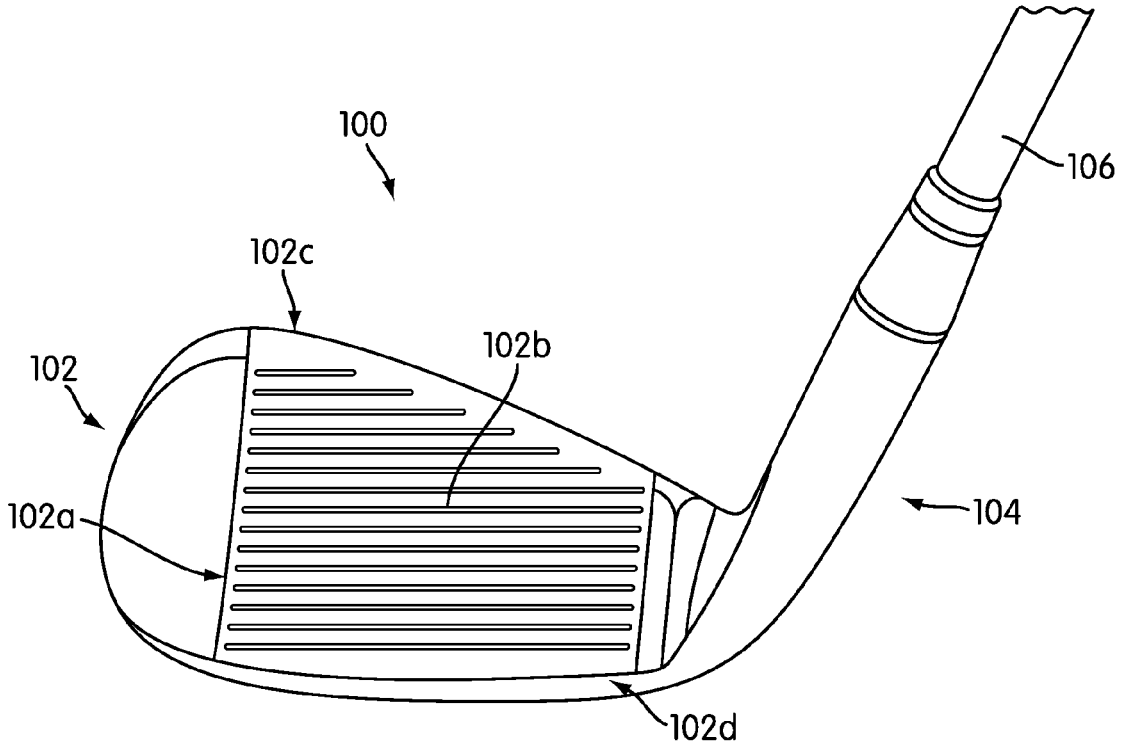
FIG. 1 generally illustrates features of a golf club structure according to at least some examples of this disclosure.

The reader is advised that the various parts shown in these drawings are not necessarily drawn to scale.

DETAILED DESCRIPTION

The following description and the accompanying figures disclose features of golf club heads and golf clubs in accordance with examples of the present disclosure.

I. General Description of Example Gold Club Heads, Golf Clubs, and Methods in Accordance with this Disclosure As described above, aspects of this disclosure relate to iron-type golf club heads and golf clubs. Iron-type golf club heads according to at least some example aspects of this disclosure may include: (a) an iron-type golf club head body; (b) a ball striking face; (c) a rear surface opposite the ball striking face, optionally including a perimeter weighting member extending rearward from the ball striking face and along at least a portion of a circumferential area of the golf club head body; and (d) an indicator.

According to aspects of this disclosure, the indicator may indicate the location of the center of gravity of the golf club head body. Therefore, according to such aspects of this disclosure, in a set of golf clubs wherein each golf club head body has a different center of gravity, the indicator for each golf club head body may be different (e.g., differently shaped) and/or differently positioned in order to reflect the different location of the center of gravity of each particular golf club head body in the set. For example, because the center of gravity of a golf club head body for a pitching wedge may be different that the center of gravity of a golf club head body for a 5-iron, the indicator for the pitching wedge will indicate a location which is different from the location indicated by the indicator on the 5-iron.

According to aspects of this disclosure, the indicator itself (or the indicator portions which make up the indicator) may affect the location of the center of gravity of the golf club head body. For example, the weight of the indicator may affect the location of the center of gravity of the golf club head body. Further, the indicators may have different weights, different densities, different weight distributions, and/or other different weighting characteristics relative to the rest of the club head body. Therefore, according to such aspects of this disclosure, the indicator may be positioned so that it will alter the center of gravity of the club head body. In other words, the positioning of the indicator relative to the club head body can be controlled in order to provide a particular center of gravity for a golf club head body. As described below, providing a particular center of gravity for a golf club head body can be advantageous.

According to some aspects of this disclosure, the indicator may be positioned in "long" iron type golf clubs (i.e., irons with a relatively low degree of loft, e.g., a 3-iron) to provide a center of gravity of the golf club head body which is closer to the heel of the club head body (i.e., near the hosel). Such a configuration decreases the distance from the hosel to the center of gravity of the golf club head body. Because the center of gravity is closer to the hosel, the golfer can more quickly and easily rotate the golf club head body (e.g., from an open club face position to a closed club face position). Hence, such a configuration can aid a golfer in imparting "draw" trajectory to the golf ball. A "draw" is a golf shot in which the golfer curves the ball in a direction opposite to the side from which it was struck. For example, for a right handed golfer, the golf ball will have "right to left" trajectory. The ball flight for a "draw" tends to have less back spin and, therefore, the ball tends to roll further once it lands. Also, "draws" tend to exhibit lower ball flights. These aspects of a "draw" (i.e., less back spin, further roll and lower ball flight) tend to increase the distance that the golf ball will travel upon being struck by the golfer. Therefore, providing the center of gravity of the golf club head body near the heel can increase the distance of a golf shot, which may be particularly useful in "long" irons.

According to some other aspects of this disclosure, the indicator may be positioned in "short" iron type golf clubs (i.e., irons with a relatively high degree of loft, e.g., a 9-iron, wedges, etc.) to provide a center of gravity of the golf club head body which is closer to the toe of the club head body. Such a configuration increases the distance from the hosel to the center of gravity of the golf club head body. Because the center of gravity is further away from the hosel, the golfer cannot rotate the golf club head body as quickly or easily (e.g., from an open club face position to a closed club face position). Therefore, the stability of the golf shot is increased. Hence, such a configuration can aid a golfer in imparting "fade" trajectory to the golf ball. A "fade" is a golf shot in which the golfer curves the ball a direction corresponding to the side from which it was struck. For example, for a right handed golfer, the golf ball will have "left to right" trajectory. The ball flight for a "fade" tends to have more back spin and, therefore, the ball tends to roll less once it lands. Also, "fades" tend to exhibit higher ball flights. These aspects of a "fade" (i.e., more back spin, less roll and higher ball flight) tend to stop the ball from rolling. Therefore, providing the center of gravity of the golf club head body near the toe can aid the golfer in stopping the ball from rolling when it lands on the green, which may be particularly useful in "short" irons.

According to some other aspects of this disclosure, the indicator may be positioned in "middle" iron type golf clubs (i.e., irons with a relatively intermediate degree of loft, e.g., a 5-iron) to provide the center of gravity of the golf club head body generally near the center of the club head body. Such a configuration can create a relatively intermediate distance from the hosel to the center of gravity of the golf club head body. Because the center of gravity is at a relatively intermediate distance from the hosel (e.g., near the center of the golf club head body) the "middle" irons will have some characteristics from each of the above described "long" and "short" irons (e.g., further distance and better ball control), but not to the same extent.

Additional aspects of this disclosure relate to iron-type golf club structures that include golf club heads, e.g., of the types described above. Such iron-type golf club structures further may include one or more of: a shaft member attached to the club head (optionally via a separate hosel member or a hosel member provided as a part of one or more of the club head and/or shaft); a grip or handle member attached to the shaft member; additional weight members; medallions; etc.

Still additional aspects of this disclosure relate to methods for producing iron-type golf club heads and iron-type golf club structures in accordance with examples of this disclosure. Such methods may include, for example, one or more of the following steps in any desired order and/or combinations: (a) providing a golf club head body of the various types described above (including any or all of the various structures, features, and/or arrangements described above), e.g., by manufacturing or otherwise constructing the golf club head body, by obtaining it from a third party source, etc.; (b) engaging a shaft member with the golf club head body; and (c) engaging a grip member with the shaft member.

Given the general description of various example aspects of the disclosure provided above, more detailed descriptions of various specific examples of golf clubs and golf club head structures according to the disclosure are provided below.

II. Detailed Description of Example Golf Club Heads, Golf Club Structures, and Methods According to the Disclosure The following discussion and accompanying figures describe various example golf clubs and golf club head structures in accordance with the present disclosure. When the same reference number appears in more than one drawing, that reference number is used consistently in this specification and the drawings to refer to the same or similar parts throughout.

More specific examples and features of iron-type golf club heads and golf club structures according to this disclosure will be described in detail below in conjunction with the example golf club structures illustrated in FIGS. 1-4.

FIG. 1 generally illustrates an example of an iron-type golf club 100 and/or golf club head body 102 in accordance with the present disclosure. In addition to the golf club head body 102, the overall golf club structure 100 of this example includes a hosel region 104, a shaft member 106 received in and/or inserted into and/or through the hosel region 104, and a grip or handle member (not shown) attached to the shaft member 106. Optionally, if desired, the external hosel region 104 may be eliminated and the shaft member 106 may be directly inserted into and/or otherwise attached to the head member 102 (e.g., through an opening provided in the top of the club head body 102, through an internal hosel member (e.g., provided within an interior chamber defined by the club head body 102), etc.). The hosel member 104 may be integrally formed as part of the club head structure 102, or it may be separately formed and engaged therewith (e.g., by adhesives or cements; by welding, brazing, soldering, or other fusing techniques; by mechanical connectors; etc.). Conventional hosels and their inclusion in an iron type club head structure may be used without departing from this disclosure.

The shaft member 106 may be received in, engaged with, and/or attached to the club head body 102 in any suitable or desired manner, including in conventional manners known and used in the art, without departing from the disclosure. As more specific examples, the shaft member 106 may be engaged with the club head body 102 via a hosel member 104 and/or directly to the club head structure 102, e.g., via adhesives, cements, welding, soldering, mechanical connectors (such as threads, retaining elements, or the like), etc.; through a shaft-receiving sleeve or element extending into the club head body 102; etc. If desired, the shaft 106 may be connected to the head 102 in a releasable manner using mechanical connectors to allow easy interchange of one shaft for another on the head.

The shaft member 106 also may be made from any suitable or desired materials, including conventional materials known and used in the art, such as graphite based materials, composite or other non-metal materials, steel materials (including stainless steel), aluminum materials, other metal alloy materials, polymeric materials, combinations of various materials, and the like. Also, the grip or handle member (not shown) may be attached to, engaged with, and/or extend from the shaft member 106 in any suitable or desired manner, including in conventional manners known and used in the art, e.g., using adhesives or cements; via welding, soldering, brazing, or the like; via mechanical connectors (such as threads, retaining elements, etc.); etc. As another example, if desired, the grip or handle member (not shown) may be integrally formed as a unitary, one-piece construction with the shaft member 106. Additionally, any desired grip or handle member materials may be used without departing from this disclosure, including, for example: rubber materials, leather materials, rubber or other materials including cord or other fabric material embedded therein, polymeric materials, and the like.

The club head body 102 itself also may be constructed in any suitable or desired manner and/or from any suitable or desired materials without departing from this disclosure, including from conventional materials and/or in conventional manners known and used in the art. For example, in the example structure shown in FIG. 1, the club head body 102 includes a ball striking face member 102*a* (including a ball striking face plate 102*b* integrally formed with the face member 102*a* or attached to a frame member such that the face plate 102*b* and frame member together constitute the overall face member 102*a*). The club head body 102 of this illustrated example further includes a top, or crown, portion 102*c* and a sole portion 102*d*. The club head body 102 and/or its various parts may be made by forging, casting, molding, and/or using other techniques and processes, including techniques and processes that are conventional and known in the art.

A wide variety of overall club head constructions are possible without departing from this disclosure. For example, if desired, some or all of the various individual parts of the club head body 102 described above may be made from multiple pieces that are connected together (e.g., by adhesives or cements; by welding, soldering, brazing, or other fusing techniques; by mechanical connectors; etc.). The various parts (e.g., top portion 102*c*, sole portion 102*d*, etc.) may be made from any desired materials and combinations of different materials, including materials that are conventionally known and used in the art, such as metal materials, including lightweight metal materials, composite materials, polymer materials, etc.

The dimensions and/or other characteristics of a golf club head structure 102 according to examples of this disclosure may vary significantly without departing from the disclosure. For example, any iron type club head may be provided including, for example: iron type hybrid clubs, driving irons, 0 through 10 irons, wedges (e.g., pitching wedges, lob wedges, gap wedges, sand wedges, etc.), chipping clubs, etc.

Figure 2A:
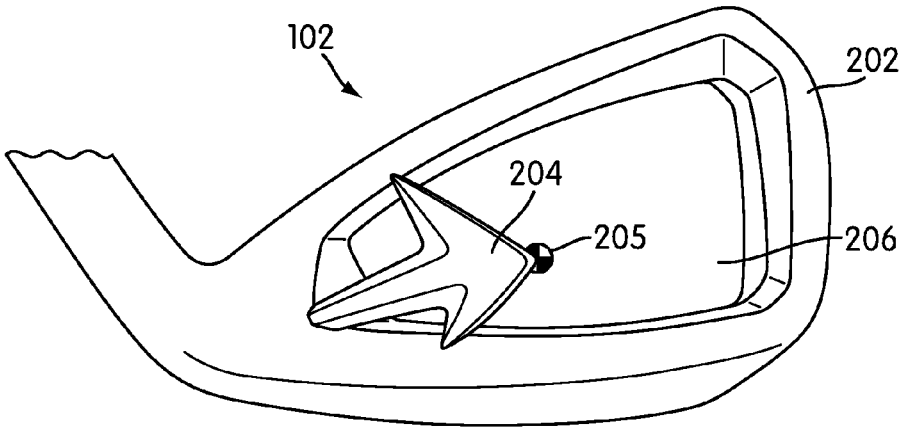
FIGS. 2A-C illustrates a golf club head structure according to at least some examples of this disclosure.
Figure 2B:
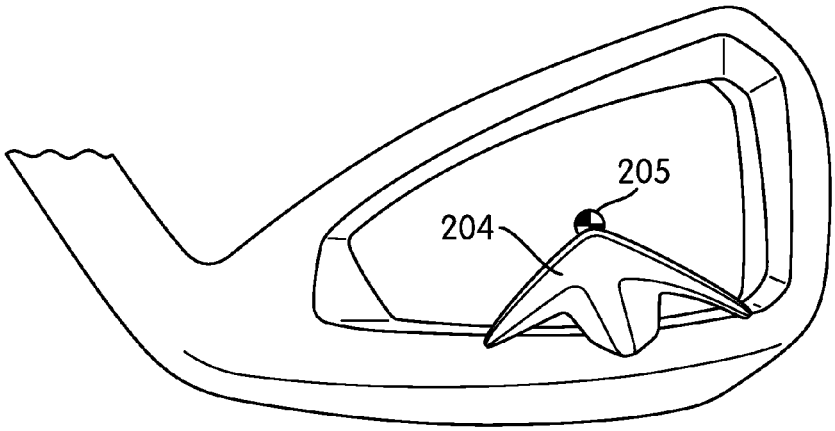
Figure 2C:
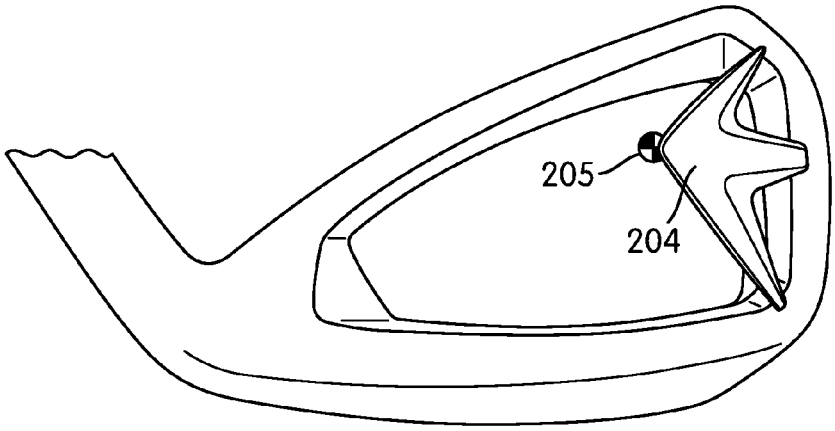

FIGS. 2A-E illustrate example features and structures that may be included in golf clubs and golf club head bodies in accordance with examples of this disclosure. As seen in FIGS. 2A-C, the golf club head body 102 may include a perimeter weighting member 202. As shown in FIGS. 2A-C, the perimeter weighting member 202 may extend rearwardly from the ball striking face 102*a* and along at least a portion of a circumferential area of the golf club head body 102.

Further, according to aspects of this disclosure, the golf club head body 102 may include an indicator 204 which indicates the golf club head body's center of gravity denoted symbolically at reference numeral 205. For example, according to some aspects of this disclosure, the indicator 204 may be either a portion of the perimeter weighting member 202 of the golf club head body 102 or a separate element(s) (e.g., made from the same or different materials as the perimeter weighting member) that is attached to the perimeter weighting member 202. In such structures the indicator 204 may be positioned at least along the top, bottom or side portions of the perimeter weighting member 202 and may form a substantial portion of at least one of the top, bottom or side of the perimeter weighting member 202. In the depicted embodiment, the indicator 204 extends from the perimeter weighting member 202 into the cavity 206 in the rear portion of the club head body 102 and has three points of contact with the perimeter weighting member 202. Further, as seen in the depicted embodiment the indicator is shaped like an arrow. The arrow points towards the golf club head body's center of gravity 205 and specifically, according to some aspects of this disclosure, the arrow will point to the precise location of the golf club head body's center of gravity 205. This allows the golfer to actually see the position of the center of gravity for each golf club head body in the set (e.g., during practice). Hence, when the golfer uses the golf club (e.g., during a round), the golfer will know that the center of gravity for each golf club body in the set is correct (i.e., in the correct position). This is useful for a golfer when choosing a club from his golf bag for a particular golf shot, because in addition to a number or letter that is typically imprinted on the sole of the club head body to identify the golf club, the above described indicator provides additional confirmation that the correct club was chosen.

Of course the indicator 204 need not be shaped like an arrow and instead other embodiments of the indicator 204 could be employed. For example, instead of an arrow-shaped indicator, a solid, triangular shape could be used. Further, the indicators 204 need not be "pointed" (e.g., triangularly or arrow-shaped). For example, the indicators 204 may be curved, arched, rounded, multi-leveled, stepped, etc. Hence, it is realized that the specific structure of the indicator 204 may vary without departing from this disclosure. In fact, the indicator 204 need not have a structure at all. For example, instead of physical structures, colors or graphics (e.g., characters) may be employed. For example, a colored dot, arrow head, etc. could be imprinted or etched in the club head body 102 to reflect the center of gravity of the club head body 102. Hence, it is realized that as long as the indicator 204 reflects the location of the center of gravity of a particular golf club head body 102, it is considered within the scope of the disclosure.

Figure 2D:
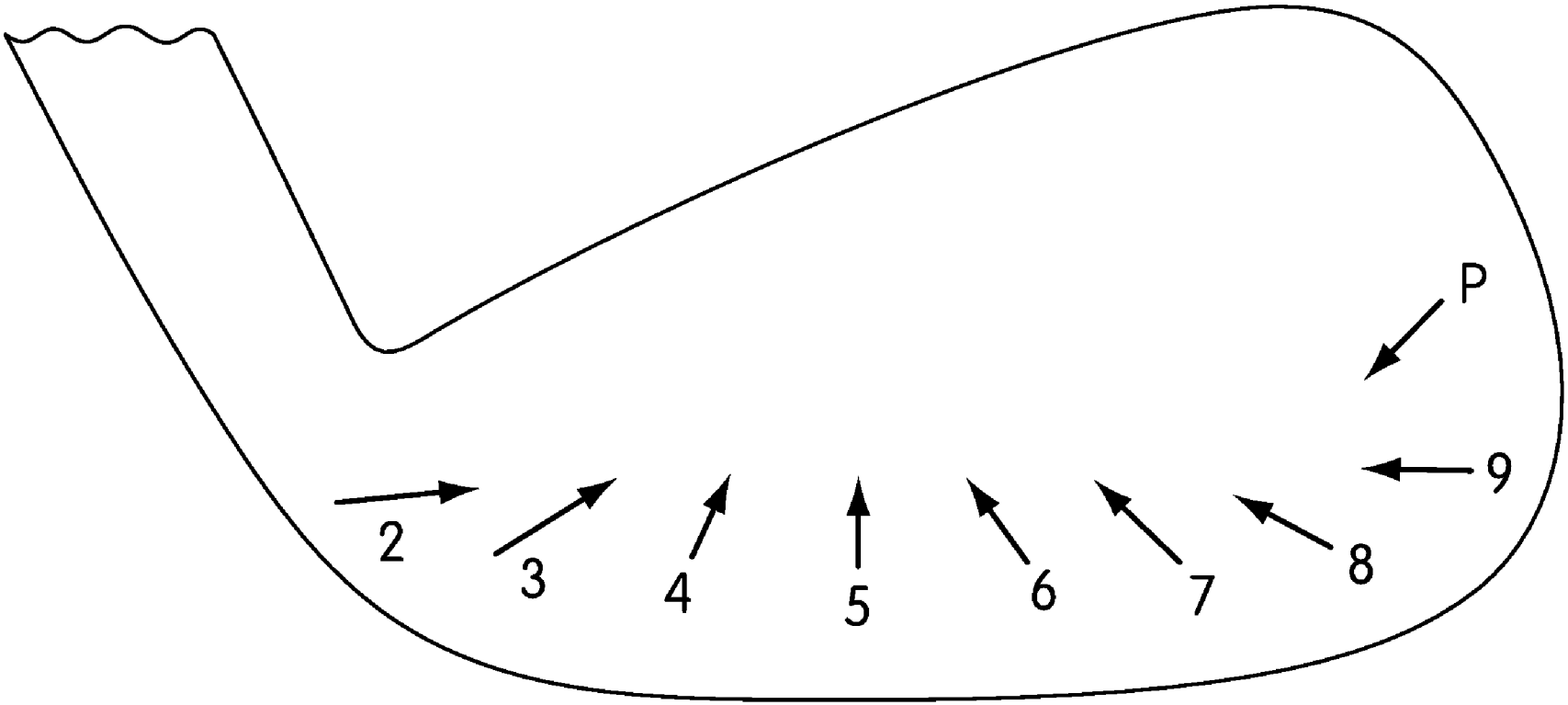
FIG. 2D schematically shows a progression of an indicator position around the circumference of the club head bodies in a set of golf clubs according to examples of this disclosure.

According to some aspects of this disclosure, in a set of golf clubs wherein each golf club head body has a different center of gravity, the indicator 204 for each golf club head body 102 may be different (e.g., a differently shaped element) and/or positioned differently in order to reflect the different location of the center of gravity of each particular golf club head body in the set. For example, FIGS. 2A-C illustrate golf club head bodies of such a set of golf clubs. FIG. 2A is an illustrative embodiment of a golf club head body 102 for a "long" iron (e.g., a 3-iron), FIG. 2B is an illustrative embodiment of a golf club head body 102 for a "middle" iron (e.g., a 5-iron), and FIG. 2C is an illustrative embodiment of a golf club head body 102 for a "short" iron (e.g., a 9-iron). As can be seen by comparing FIGS. 2A, 2B and 2C, the different golf club head bodies each have a different center of gravity 205 and, further, the indicators 204 are positioned to reflect the respective centers of gravity 205 for the different golf club head bodies. FIG. 2D schematically shows an entire progression of the indicator position around the circumference of the club head bodies in a set of golf clubs according to such an embodiment of this disclosure. As seen in FIG. 2D, the progression begins as a 2-iron (one of the club head bodies with a low degree of loft relative to the set of club head bodies) with the indicator 204 positioned generally at the heel end of the club head body 102. The progression continues successively in a counter clockwise fashion around the circumference of the club head body 102 from the heel through the center bottom portion of the club head body 102 and towards the toe of the club head body 102 until the progression ends as a pitching wedge (one of the club head bodies with a high degree of loft relative to the set of club head bodies) with the indicator 204 positioned at the upper toe end of the club head body 102. In this way, the indicator 204 of each golf club head body reflects the different center of gravity for each particular golf club head body 102 in the set of golf clubs. It is noted of course, that this is merely one embodiment of a set of golf clubs according to this disclosure and other sets of golf clubs according to this disclosure may include other clubs, such as sand wedges, lob wedges, hybrids irons, etc.

It is noted that other desired progressions (e.g., counter clockwise from the toe around the crown of the club head body to the heel) or arrangements may be provided without departing from this disclosure. Also, it is noted that the arrangement of the indicators 204 does not necessarily require that the indicators 204 be positioned around the circumference of the club head body 102 (e.g., the indicators 204 may be completely within the cavity 206). Therefore, it is realized that the indicators 204 may be positioned or arranged in or around the golf club head bodies of a set of golf clubs in a variety of different manners, orientations, and the like without departing from this disclosure.

According to some aspects of this disclosure, in addition to merely indicating the location of the center of gravity of the club head body 102, the positioning of the indicator 204 can be used to alter (e.g., shift) the center of the gravity of the club head body 102. For example, due to the indicator's weighting characteristics (weight, density, etc.), the position of the indicator 204 with respect to the club head body 102 will redistribute the weight of the golf club head body 102 (as compared to the golf club head body without the indicator 204) and thereby shift club head body's center of gravity 205. Therefore, the indicator 204 can be selectively positioned to control features of the club head's center of gravity 205.

For example, according to some aspects of this disclosure, the indicator 204 may have a different weight, a different density, a different weight distribution, and/or other different weighting characteristics than the perimeter weighting member 202 or other portions of the club head body 102. For example, the indicator 204 may be made heavier as compared to the other parts of the golf club head (e.g., by including a weighted mass, such as lead or tungsten containing material, etc. in the indicator 204). Yet, according to some other aspects of this disclosure, the indicator 204 may have the same weighting characteristics (weight, density, etc.) as the perimeter weighting member 202 or other portions of the club head body 102. Further, it is noted that, different sections or portions of the perimeter weighting member 202 may also have a different weight, a different density, a different weight distribution, and/or other different weighting characteristics than other sections or portions of the perimeter weighting member 202. For example, the crown portion of the perimeter weighting member 202 may be less dense the sole portion of the perimeter weighting member 202. Regardless of whether the indicator 204 has the same or different weighting characteristics as the perimeter weighting member 202 (or at least portions of the perimeter weighting member 202) or other portions of the club head body 102, the indicator 204 can be still be selectively positioned to control features of the club head's center of gravity 205. Further, the shape or thickness of the indicator 204 can be varied to set the weight distribution as desired. For example, the structure of the arrow head or tail of the depicted indicator 204 can be modified in order to distribute the weight of the indicator as desired. In other words, one side of the arrow head could be formed so that it weighs more than the other side of the arrow head thereby shifting the center of the gravity of the club head body 102. Alternatively, or additionally, the tail could be shortened or lengthened thereby shifting the center of the gravity of the club head body 102.

Further, by positioning the indicator 204 around the circumference of the club head body 102 (e.g., as shown in FIG. 2D), the center of gravity of the club head body may be adjusted both vertically and horizontally. For instance, as mentioned above, FIGS. 2A-C illustrate the different locations of centers of gravity 205 for some different arrangements of the indicators 204 of the golf club head bodies. In the arrangement shown in FIG. 2A, the indicator 204 extends generally from the heel end of the club head body 102 towards the cavity 206. Therefore, the center of gravity 205 of this arrangement is closer to the heel of the club head body (e.g., closer to the heel than the toe). In contrast, as shown in FIG. 2C, the indicator 204 extends generally from the toe end of the club head body 102 towards the cavity 206. Therefore, the center of gravity of this arrangement is closer to the toe of the club head body 102 (e.g., closer to the toe than the heel). These different locations of the center of gravity 205 of the club head bodies can affect the trajectory and ball flight of a golf ball struck by the golf club.

Hence, it is understood that positioning indicators 204 (e.g., weighted indicators) in golf club head bodies according to the schematic shown in FIG. 2D can produce a set of golf clubs with desirable characteristics. For example, the configuration of FIG. 2A decreases the distance from the hosel to the center of gravity. Therefore, a "long" iron of such a set of golf clubs has a club head body with a center of gravity near the hosel. Hence, as discussed above, such "long" irons can aid a golfer in imparting a "draw" trajectory to the golf ball and, therefore, provide characteristics of a "draw" shot (i.e., less spin, further roll and lower ball flight) which will tend to increase the distance that the golf ball will travel upon being struck by the golfer. Conversely, the configuration of FIG. 2C increases the distance from the hosel to the center of gravity 205. Therefore, a "short" iron of such a set of golf clubs has a club head body with a center of gravity 205 near the toe. Hence, as discussed above, such "short" irons can aid a golfer in imparting "fade" trajectory to the golf ball and, therefore, provide characteristics of a "fade" shot (i.e., more spin, less roll and higher ball flight) which tend to provide enhanced ball control (e.g., stopping the ball on the green).

The weighting features of golf club heads in accordance with this disclosure are not limited to controlling the horizontal position of the golf club's center of gravity (the horizontal position when the golf club is oriented at a ball addressing position). Rather, the center of gravity in the vertical direction also may be selectively controlled, if desired, in at least some examples of golf club head structures according to this disclosure. Increasing the weight in the crown area of the club head (e.g., by providing a weighted indicator closer to the crown), produces a higher center of gravity in the golf club head which can provide a more boring golf ball flight path, e.g., for play in windy conditions, to provide more "running" shots, and/or to help compensate for swing flaws that typically produce an excessively high ballooning flight. Conversely, increasing the weight in the sole area of the club head (e.g., by providing a weighted indicator closer toward the sole), produces a higher center of gravity in the golf club head which can provide a more lofted golf ball flight path, which can help a golfer get the ball in the air.

Figure 2E:
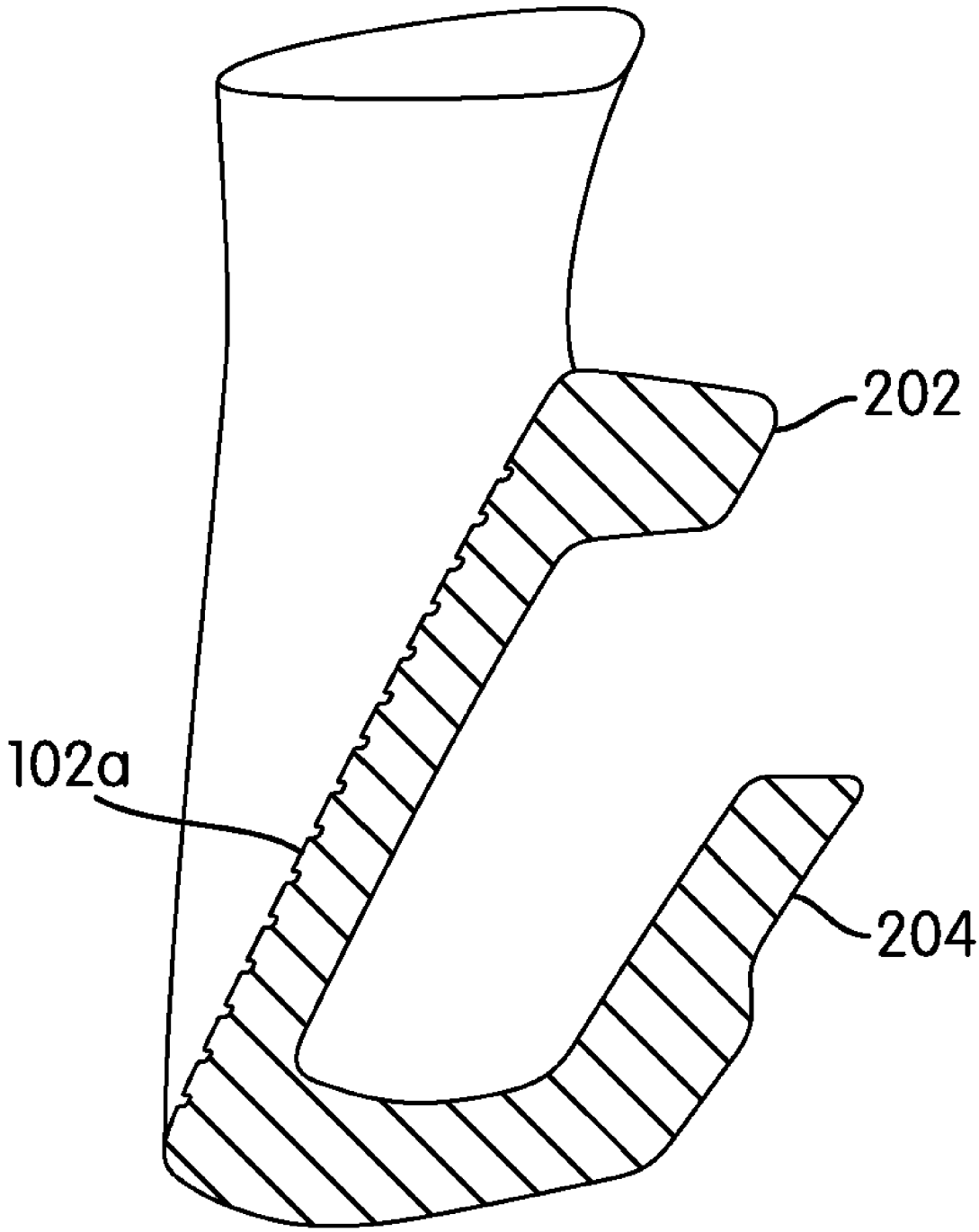
FIG. 2E illustrates a cross sectional view of golf club head structure according to at least some examples of this disclosure.

According to some aspects of this disclosure, the indicator 204 can be positioned away from the face of the golf club head body 102. For example, the indicator 204 may be suspended from the heel, toe, sole or crown of the golf club head body 102. FIG. 2E shows a cross-sectional view of an illustrative embodiment of the disclosure wherein the indicator 204 is suspended from the sole of the golf club head body 102 and, therefore, positioned off of and away from the rear surface of the face of the golf club head body 102. By positioning the indicator 204 away from the face of the golf club head body 102, the center of gravity of the golf club head body 102 can be shifted away from the face of the golf club head body 102. In such an embodiment, it will be realized that the indicator 204 indicates the center of gravity by pointing to a point in space above the center of gravity. However, when viewed straight on from an angle such as seen in FIGS. 2A-C, the indicator will, in fact, point to the center of gravity. Of course, according to some aspects of the disclosure the indicator 204 could be angled toward or away from the rear surface of the club head body 102.

Therefore, it can be seen that selectively positioning of the indicator 204 relative to the golf club head body 102 affects the center of gravity of the golf club head. In this way, when the indicator portion 204 is positioned at particular locations around the golf club head body 102, the indicator 204 alters the weight distribution of the golf club head body 102 to move the club head body's center of gravity 205 to a desired position. Additionally, it can be seen that according to aspects of this disclosure, the indicator 204 can both indicate the precise position of the center of gravity of the golf club head body and, also, if desired, be selectively positioned to shift the weight of the golf club head body 102 in order to move the club head body's center of gravity 205 to a desired position.

As mentioned above, the indicator may take on a wide variety of forms without departing from the spirit of disclosure. According to some aspects of this disclosure, the indicator may comprise one or more indicator portions which together make up the indicator. For example, a first indicator portion may be a bridge member which extends from approximately the crown to the sole and a second indicator portion may be a bridge member which extends from approximately the heel to the toe. Further, the point where the first and second indicator portions overlap or "cross" each other indicates the club head body's center of gravity.

Figure 3A:
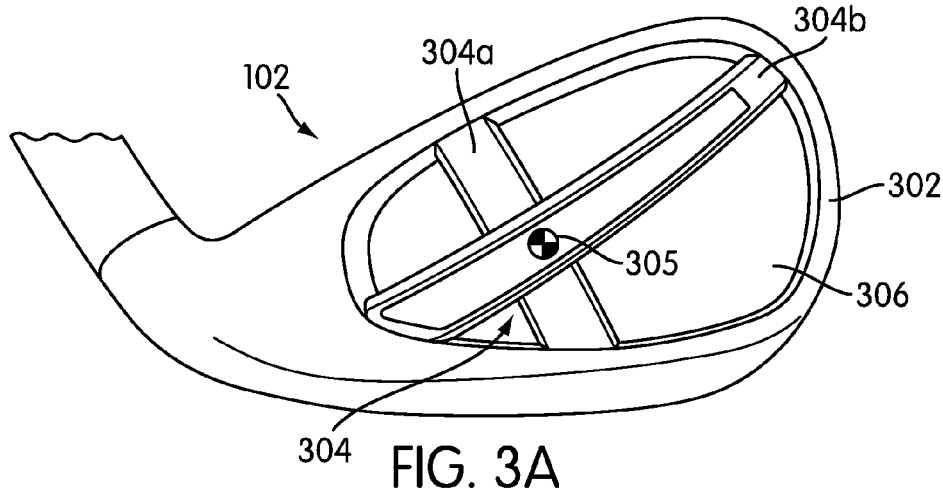
FIGS. 3A-C illustrates a golf club head structure according to at least some examples of this disclosure.
Figure 3B:
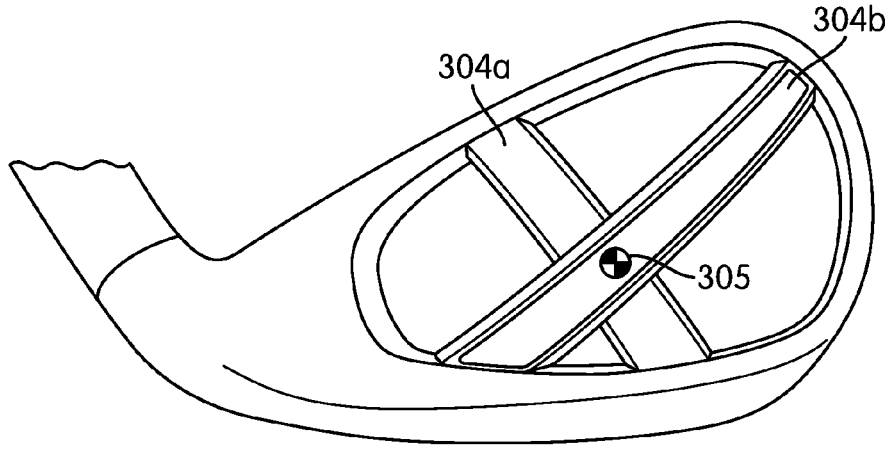
Figure 3C:
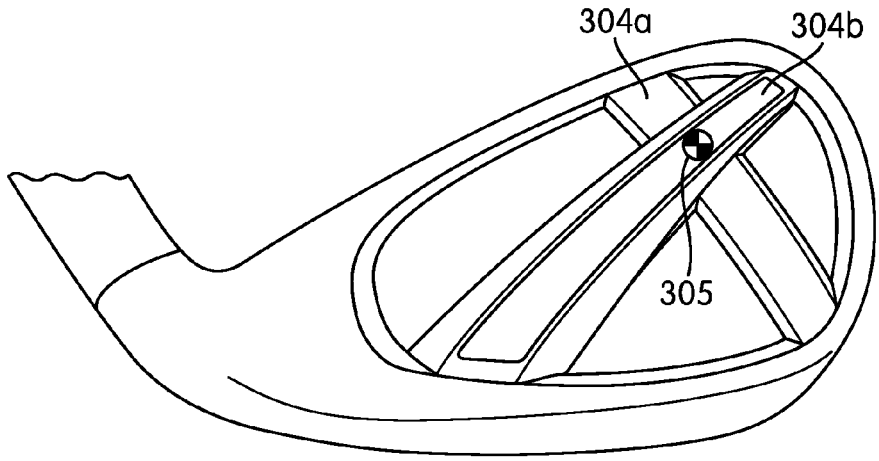

FIGS. 3A-C illustrate such example structures that may be included in golf clubs and golf club head bodies in accordance with this disclosure. As seen in FIGS. 3A-C, each golf club head body 102 includes a perimeter weighting member 302 (similar to the perimeter weighting member described above) and an indicator 304 which includes two indicator portions 304*a* and 304*b*. According to some aspects of this disclosure, the indicator portions 304*a* and 304*b* may be either: portions of the perimeter weighting member 302 of the golf club head body 102 or separate elements (e.g., made from the same or different materials as the perimeter weighting member) that are attached to the perimeter weighting member 302. In such structures the indicator portions 304*a* and 304*b* may be positioned at least along the top, bottom or side portions of the perimeter weighting member 302 and may form a substantial portion of at least one of the top, bottom or side of the perimeter weighting member 302.

In the depicted embodiment, the first indicator portion 304*a* is a bridge member that extends over the cavity 306 of the club head body 102 from the top portion of a perimeter weighting member 302 to the bottom portion of the perimeter weighting member 302 and the second indicator portion 304*a* is a bridge member that extends over the cavity 306 from a heel side portion of the perimeter weighting member 302 to a toe side portion of the perimeter weighting member 302. The point where the indicator portions, bridge members 304*a* and 304*b* cross indicates the club head body's center of gravity denoted symbolically at reference numeral 305. In the depicted embodiment the second indicator portion, bridge member 304*b* is positioned over the first indicator portion, bridge member 304*a*, but this could be reversed if desired.

As discussed above in regard to the previously described embodiment, according to some aspects of this disclosure, in a set of golf clubs wherein each golf club head body has a different center of gravity, the indicator for each golf club head body 102 may be different (e.g., a differently shaped element) and/or positioned differently in order to reflect the different location of the center of gravity of each particular golf club head body in the set. FIGS. 3A-C illustrate golf club head bodies of such a set of golf clubs. FIG. 3A is an illustrative embodiment of a golf club head body 102 for a "long" iron (e.g., a 3-iron), FIG. 3B is an illustrative embodiment of a golf club head body 102 for a "middle" iron (e.g., a 5-iron), and FIG. 3C is an illustrative embodiment of a golf club head body 102 for a "short" iron (e.g., a 9-iron). As can be seen by comparing FIGS. 3A, 3B and 3C, the different golf club head bodies each have a different center of gravity 305 and, further, the indicators 304 are positioned to reflect the respective centers of gravity 305 for the different golf club head bodies.

As seen by comparing FIGS. 3A, 3B and 3C, according to depicted embodiment, the progression of center of gravity 305 of the club head body 102 moves generally successively from the lower heel in "long" irons to the upper toe in "short" irons. For example, the first indicator portion 304*a* shifts from the heel end in "long" irons to the toe end in "short" irons (as seen the second indicator portion 304*b* can shift also). In this way, the crossing of the indicator portions 304*a* and 304*b* of each golf club head body 102 reflects the different center of gravity for each particular golf club head body 102. However, as mentioned above with regard to the previously described embodiment, this is merely one embodiment of the disclosure and other desired progressions or arrangements or the indicators may be provided without departing from this disclosure (e.g., the first indicator portion, bridge member 304*a* could shift in an opposite direction (i.e., from the toe end in "long" irons to the heel end in "short" irons)). Therefore, it is realized that the indicator portions 304*a* and 304*b* may be positioned or arranged in or around the golf club head bodies of a set of golf clubs in a variety of different manners, orientations, and the like without departing from this disclosure.

As discussed above in regard to the previously described embodiment, according to some aspects of this disclosure, in addition to merely indicating the location of the center of gravity of the club head body 102, the positioning of the indicator 304 can be used to alter (e.g., shift) the center of the gravity of the club head body 102. For example, due to weighting characteristics (weight, density, etc.) of the indicator portions, the position of the indicator portions 304*a* and 304*b* with respect to the club head body 102 will redistribute the weight of the golf club head body 102 (as compared to the golf club head body without the indicator 304) and thereby shift the club head body's center of gravity 305. Therefore, the indicator portions 304*a* and 304*b* can be selectively positioned to control features of the club head's center of gravity 305.

For example, similarly to the previously described embodiment, according to some aspects of this disclosure, the indicator portions 304*a* and 304*b* may have the same or different weighting characteristics (weight, density, etc.) as the perimeter weighting member 302 or other portions of the club head body 102 including the other indicator portion. Further, the shape or thickness of the indicator portions 304*a* and 304*b* can be varied to vary the weight distribution as desired. For example, the indicator portions 304*a* and 304*b* may be relatively thick at one end and comparatively thin at the other end in order to achieve desired weight distribution.

Further, according to some aspects of the disclosure, either or both of the first and second indicator portions 304*a* and 304*b* can be shifted in either, or both, a horizontal direction (i.e., heel to toe direction) and/or a vertical (i.e., crown to sole direction) to provide a desired center of gravity 305 for the particular club head body 102. For instance, by comparing FIGS. 3A and 3C, it is seen that the different positions of the indicator portions 304*a* and 304*b* have altered the center of gravity 305 of the club head body 102. These different locations of the center of gravity 305 of the club head bodies can affect the trajectory and ball flight of a golf ball struck by the golf club. For example, since the configuration of FIG. 3A decreases the distance from the hosel to the center of gravity, it can aid the golfer in creating a draw biased golf ball flight path. Conversely, since the configuration of FIG. 3C increases the distance from the hosel to the center of gravity, it can aid the golfer in creating a fade biased golf ball flight path.

Hence, it is understood that positioning indicators portions 304*a* and 304*b* in golf club head bodies according to the depicted embodiment can produce a set of golf clubs with "long" irons that can aid a golfer in imparting a "draw" trajectory to the golf ball and, therefore, provide characteristics of a "draw" shot (i.e., less spin, further roll and lower ball flight) which will tend to increase the distance that the golf ball will travel upon being struck by the golfer. Conversely, the "short" irons of such a set of golf clubs can aid a golfer in imparting "fade" trajectory to the golf ball and, therefore, provide characteristics of a "fade" shot (i.e., more spin, less roll and higher ball flight) which tend to provide enhanced ball control (e.g., stopping the ball on the green).

Figure 3D:
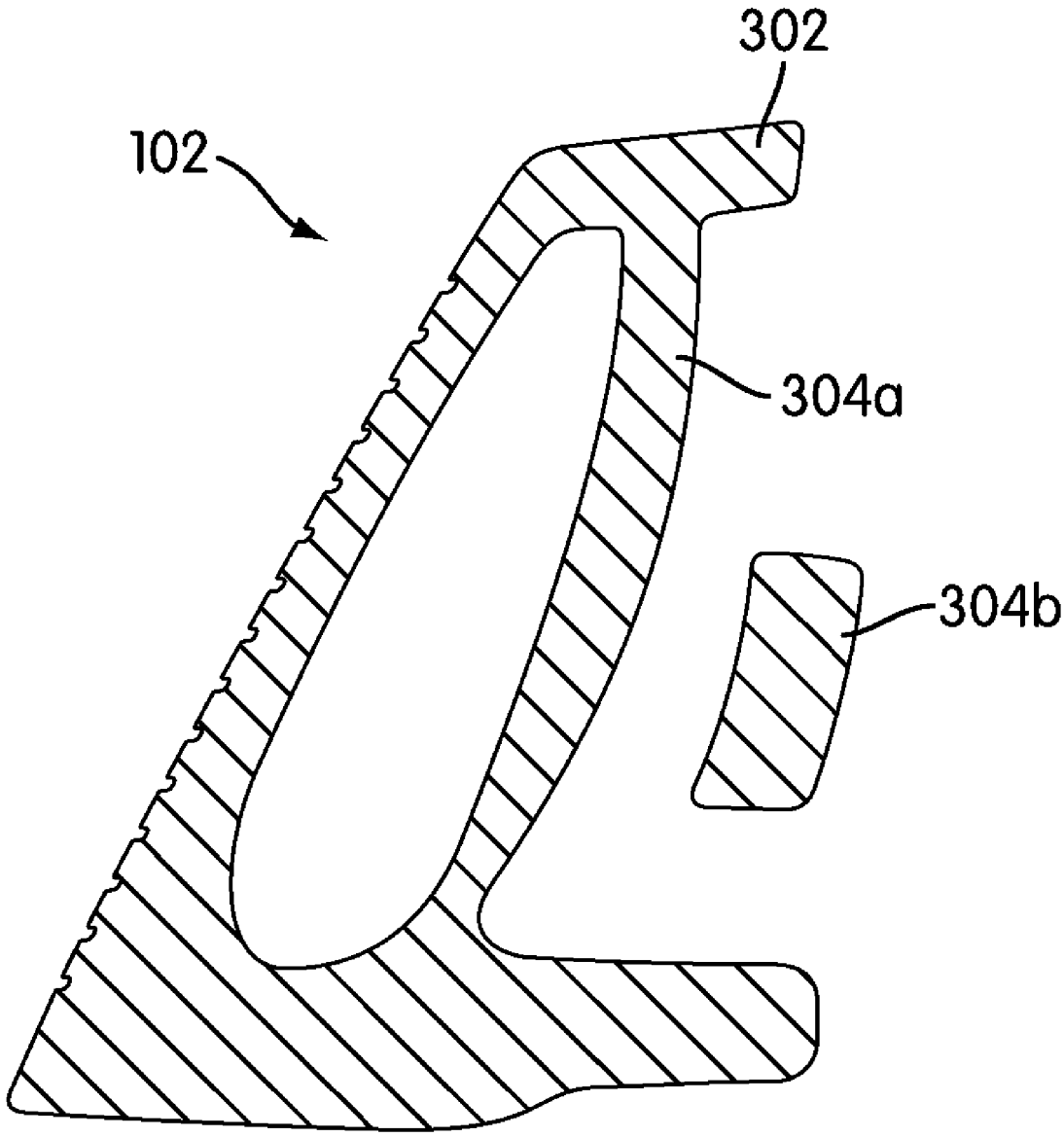
FIG. 3D illustrates a cross sectional view of golf club head structure according to at least some examples of this disclosure.

According to some aspects of this disclosure, the indicator 304 can be positioned away from the face of the golf club head body 102. For example, the indicator portions 304*a* and 304*b* may be suspended from the heel, toe, sole or crown of the golf club head body 102. FIG. 3D shows a cross-sectional view of an illustrative embodiment of the disclosure wherein the indicator portion, bridge member 304*a* is suspended from the crown and sole of the golf club head body 102 and, therefore, positioned off of and away from the rear surface of the face of the golf club head body 102. Further, the indicator portion, bridge member 304*b* is suspended from the heel and toe sides of the golf club head body 102 and, therefore, positioned off of and away from the face of the golf club head body 102. By positioning the indicator portions, bridge members 304*a* and 304*b* away from the face of the golf club head body 102, the center of gravity 305 of the golf club head body 102 can be shifted away from the face of the golf club head body 102.

Further, according to some aspects of this disclosure, the first and second indicator portions, bridge members 304*a* and 304*b* can be positioned so that they do not touch each other. In other words, there is a gap between the separate and distinct first and second indicator portions, bridge members 304*a* and 304*b*. For example, as seen in FIG. 3D, the first indicator portion, bridge member 304*a* extends over the cavity 306, but underneath the second indicator portion, bridge member 304*b* so that the two indicator portions, bridge members 304*a* and 304*b* do not contact each other. Therefore, the two indicator portions do not support one another. By positioning the indicator portions 304*a* and 304*b* so that they do not touch each other, the center of gravity of the golf club head body 102 can be shifted away from the face of the golf club head body 102.

It is noted that in addition to the depicted embodiment, other progressions or arrangements may be provided without departing from this disclosure. For example, the indicator portions do not necessarily have to extend from the crown to sole or heel to toe. Instead, the indicator portions can extend in other directions too, such as crown to heel, etc. Additionally, there may be more than two indicator portions if desired. Further, the indicator 304 may be a single piece rather than two separate indicator portions. In other words, while there are many ways in which the indicator for each club head body could be formed to indicate the respective location of the club head body's center of gravity, as long as the indicator reflects the location center of gravity of a particular golf club head body, it is considered within the scope of the disclosure.

As mentioned above, the indicator may take on a wide variety of forms without departing from the spirit of disclosure. According to some aspects of this disclosure, the indicator may include a back cover or medallion which is set in or over the cavity of the golf club head body. The back cover or medallion may be a single element or comprise one or more indicator portions which are arranged so as to provide an opening in the back cover or medallion. The opening in the back cover or medallion indicates the club head body's center of gravity.

Figure 4A:
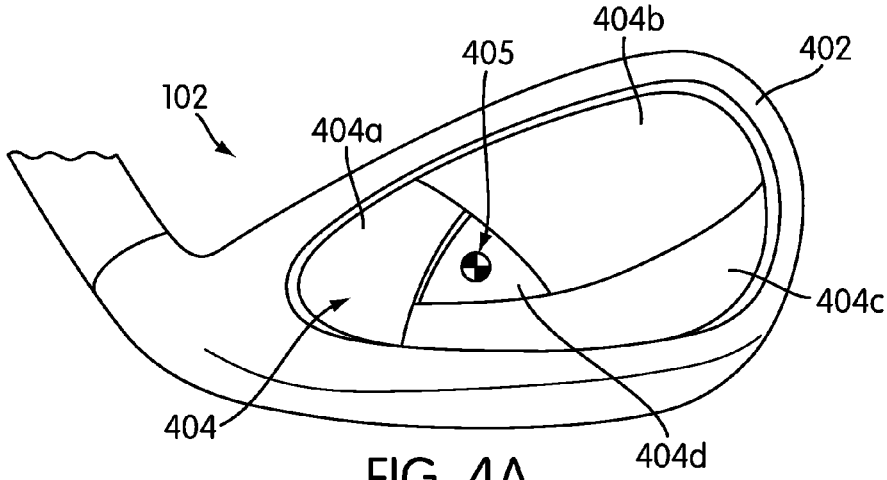
FIGS. 4A-C illustrates a golf club head structure according to at least some examples of this disclosure.
Figure 4B:
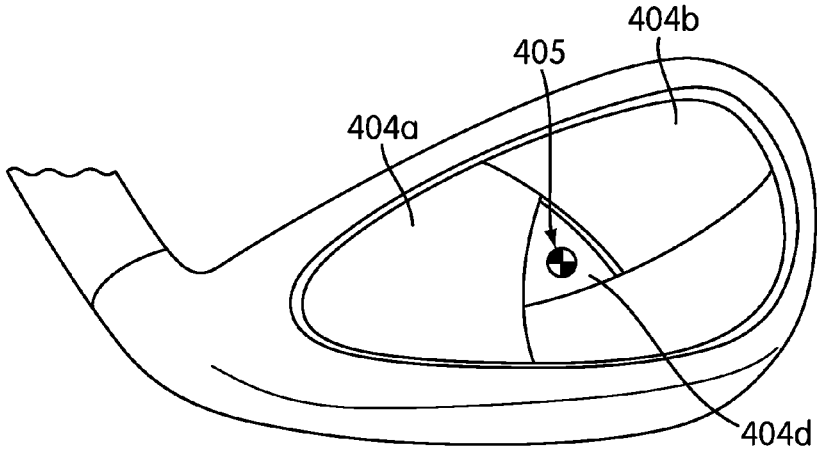
Figure 4C:
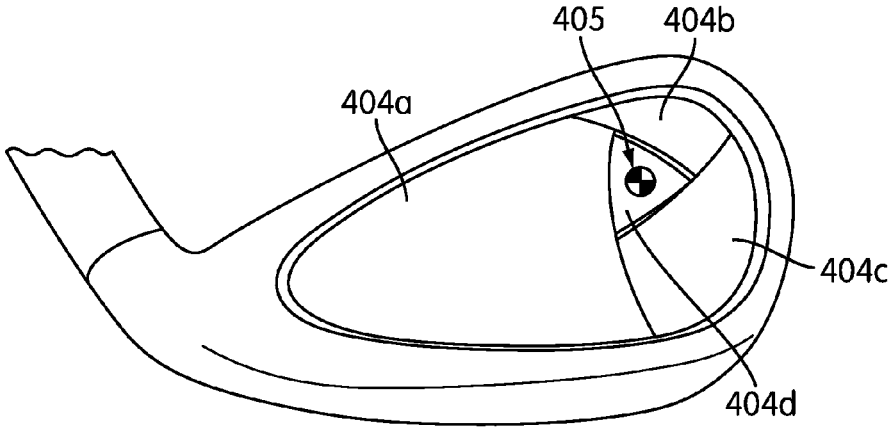

FIGS. 4A-C illustrate such an example structure that may be included in golf clubs and golf club head bodies in accordance with this disclosure. As seen in FIGS. 4A-C, each golf club head body 102 includes a perimeter weighting member 402 (similar to the perimeter weighting members described above) and an indicator 404 which includes three indicator portions 404*a*, 404*b*, 404*c* and an opening 404*d*. According to some aspects of this disclosure, the indicator portions 404*a-c* may be either: portions of the perimeter weighting member 402 of the golf club head body 102 or separate elements (e.g., made from the same or different materials as the perimeter weighting member 402) that are attached to the perimeter weighting member 402. In such structures the indicator portions 404*a-c* may be positioned at least along the top, bottom or side portions of the perimeter weighting member 402 and may form a substantial portion of at least one of the top, bottom or side of the perimeter weighting member 402.

In the depicted embodiment, the indicator portions 404*a-c* extend from the perimeter weighting member 402 over the cavity 406 of the club head body 102 in an arrangement that resembles a shutter which provides an opening 404*d* positioned between the indicator portions 404*a*, 404*b* and 404*c*. In this shutter arrangement, the indicator portions 404*a-c* may contact or overlap each other. For example, as seen in the depicted embodiment, the indicator portions 404*a-c* contact each other at their sides. In addition to contacting each other, the indicator portions 404*a-c* may be attached to each other in a variety of ways such as welding, brazing, soldering, or other fusing techniques; by mechanical connectors; etc. It is noted that alternatively the indicator 404 could be a single integral piece with an opening 404*d* positioned appropriately. The opening 404*d* indicates the club head body's center of gravity which is denoted symbolically at reference numeral 405. According to some aspects of this disclosure, the rear surface (e.g., the back of face of the golf club head body 102) may exhibit a color in order to help golfer more easily see the center of gravity 405. For example, the back of face of the golf club head body 102 may be painted a bright color (e.g., red, yellow, orange, etc.).

As discussed above in regard to the previously described embodiment, according to some aspects of this disclosure, in a set of golf clubs wherein each golf club head body has a different center of gravity, the indicator for each golf club head body 102 may be different (e.g., a differently shaped element) and/or positioned differently in order to reflect the different location of the center of gravity of each particular golf club head body in the set. FIGS. 4A-C illustrate golf club head bodies of such a set of golf clubs. FIG. 4A is an illustrative embodiment of a golf club head body 102 for a "long" iron (e.g., a 3-iron), FIG. 4B is an illustrative embodiment of a golf club head body 102 for a "middle" iron (e.g., a 5-iron), and FIG. 4C is an illustrative embodiment of a golf club head body 102 for a "short" iron (e.g., a 9-iron). As can be seen by comparing FIGS. 4A, 4B and 4C, the different golf club head bodies each have a different center of gravity 405 and, further, the indicators 404*a-c* are positioned to reflect the respective centers of gravity 405 for the different golf club head bodies.

As seen by comparing FIGS. 4A, 4B and 4C, according to the depicted embodiment, the progression of the center of gravity 405 of the club head body 102 moves generally successively from the lower heel in "long" irons to the upper toe in "short" irons. For example, the indicator portions 404*a-c* are positioned to provide the opening 404*d* near the heel in "long" irons while, conversely, in "short" irons the indicator portions 404*a-c* are positioned to provide the opening 404*d* near the toe. Also, the indicator portions 404*a-c* are positioned to provide the opening 404*d* near the center of the club head body 102 for "middle" irons. In this way, the opening 404*d* reflects the different center of gravity 405 for each particular golf club head body 102. However, as mentioned above with regard to the previously described embodiment, this is merely one embodiment of the disclosure and other desired progressions or arrangements or the indicators may be provided without departing from this disclosure (e.g., according to some embodiments of this disclosure, the progression of the indicator portions 404*a-c* may provide the opening 404*d* from the toe end in "long" irons to the heel end in "short" irons). Similarly, while the depicted embodiment shows the first indicator portion 404*a* as the smallest indicator portion in the "long" irons (see FIG. 4A), the largest indicator portion in the "short" irons (see FIG. 4C) and fairly equal in size to the other indicator portions in the "middle" irons (see FIG. 4B), other different arrangements could be employed. Hence, as long as the opening 404*d* reflects the correct center of gravity for each particular golf club head body 102, it is realized that the indicator portions 404*a-c* may be positioned in or around the golf club head bodies of a set of golf clubs in a variety of different manners, orientations, and the like without departing from this disclosure.

As discussed above in regard to the previously described embodiment, according to some aspects of this disclosure, in addition to merely indicating the location of the center of gravity 405 of the club head body 102, the positioning of the indicator portions 404*a-c* can be used to alter (e.g., shift) the center of the gravity of the club head body 102. For example, due to weighting characteristics (weight, density, etc.) of the indicator portions 404*a-c*, the position of the indicator portions 404*a-c* with respect to the club head body 102 will redistribute the weight of the golf club head body 102 (as compared to the golf club head body without the indicator 404) and thereby shift the center of gravity 405 of the club head body 102. Therefore, the indicator portions 404*a-c* can be selectively positioned to control features of the center of gravity 405 of the club head body 102.

For example, similarly to the previously described embodiment, according to some aspects of this disclosure, the indicator portions 404*a-c* may have the same or different weighting characteristics (weight, density, etc.) as the perimeter weighting member 402 or other portions of the club head body 102 including the other indicator portions. For example, the shape or thickness of the indicator portions 404*a-c* can be varied to set the weight distribution as desired. Further, according to some aspects of the disclosure, any or all of the indicator portions 404*a-c* can be made larger or smaller, and/or made heavier or lighter and/or arranged in any of a horizontal direction (i.e., heel to toe direction) and/or a vertical (i.e., crown to direction) or other direction (e.g., diagonal, etc.) to provide a desired center of gravity 405 for the particular club head body 102. For instance, by comparing FIGS. 4A and 4C, it can be seen that the different positions of the indicator portions 404*a-c* have altered the center of gravity 405 of the club head body 102 (as indicated by the opening

404*d*). According to one embodiment of the disclosure, in the "long" iron shown in FIG. 4A, the indicator portion 404*a* is heavier than the other indicator portions 404*b* and 404*c*, and, therefore despite being smaller than the other indicator portions 404*b* and 404*c*, indicator portion 404*a* shifts the center of gravity 405 towards the heel as reflected by the opening 404*d*. Conversely, in the "short" iron shown in FIG. 4C, the indicator portion 404*a* is lighter than the other indicator portions 404*b* and 404*c*, and, therefore despite being larger than the other indicator portions 404*b* and 404*c*, indicator portion 404*a* causes the center of gravity 405 to be shifted towards the toe as reflected by the opening 404*d*.

These different locations of the center of gravity of the club head bodies can affect the trajectory and ball flight of a golf ball struck by the golf club. For example, since the configuration of FIG. 4A decreases the distance from the hosel to the center of gravity, it can aid the golfer in creating a draw biased golf ball flight path. Conversely, since the configuration of FIG. 4B increases the distance from the hosel to the center of gravity, it can aid the golfer in creating a fade biased golf ball flight path.

Hence, it is understood that positioning indicators portions 404*a-c* in golf club head bodies according to the depicted embodiment can produce a set of golf clubs with "long" irons that can aid a golfer in imparting a "draw" trajectory to the golf ball and, therefore, provide characteristics of a "draw" shot (i.e., less spin, further roll and lower ball flight) which will tend to increase the distance that the golf ball will travel upon being struck by the golfer. Conversely, the "short" irons of such a set of golf clubs can aid a golfer in imparting "fade" trajectory to the golf ball and, therefore, provide characteristics of a "fade" shot (i.e., more spin, less roll and higher ball flight) which tend to provide enhanced ball control (e.g., stopping the ball on the green).

According to some aspects of this disclosure, the indicator 404 can be positioned away from the face of the golf club head body 102. For example, the indicator portions 404*a-c* may be suspended from the heel, toe, sole or crown of the golf club head body 102 and, therefore, positioned off of and away from the rear surface of the face of the golf club head body 102. By positioning the indicator 404 away from the face of the golf club head body 102, the center of gravity of the golf club head body 102 can be shifted away from the face of the golf club head body 102.

Any type of iron type golf club head structure may include indicators of the types described above (e.g., 204, 304*a-b*, 404*a-c*, etc.), including, for example: iron type hybrid clubs, driving irons, 0-10 irons, wedges (e.g., iron type clubs having lofts from 44-68 degrees, such as pitching wedges, lob wedges, sand wedges, gap wedges, etc.), chipping clubs, etc. If desired, in accordance with at least some examples of this disclosure, golf clubs and/or golf club heads in accordance with examples of this disclosure may be sold or marketed as a set including plural irons, including, for example, sets having two or more of iron type hybrid clubs, driving irons, 0-10 irons, pitching wedges, lob wedges, sand wedges, gap wedges, and/or chipping clubs. When present in a set, any desired number of the clubs in the set may have a club head with an indicator in accordance with this disclosure. In some more specific examples, sets of golf clubs in accordance with this disclosure may contain at least the 3-9 irons and a pitching wedge, wherein at least 2 of these irons (and in some examples, all of these irons) will have a club head with indicator in accordance with examples of this disclosure. As another example, sets of golf clubs in accordance with this disclosure will contain at least the 4-9 irons (or even 5-9 irons or 6-9 irons) and a pitching wedge, and optionally a sand wedge and/or one or more iron type hybrid clubs, wherein at least 2 of these clubs (and in some examples, all of these clubs) will have a club head with an indicator in accordance with examples of this disclosure.

Iron type golf club heads including indicators in accordance with examples of this disclosure are not limited for use with perimeter weighted and/or cavity back type clubs of the types illustrated in FIGS. 1-4. Rather, if desired, indicators may be provided (e.g., in similar positions and/or arrangements) in blade type iron clubs or other iron type golf club head structures without departing from this disclosure. Rather than forming a portion of a perimeter weight member, in blade type clubs, the indicators may be located in at least one of the upper rear portion of the back side of the club, the lower rear portion of the rear portion of the back side of the club, the club sole, etc.

Further, for example, it is noted that while the indicators have been discussed above as indicating the center of gravity of a golf club head body, the indicators could indicate other features of the golf club head (e.g., "sweet spot", etc.) as well. Finally, it is noted that the specific indicators discussed in detail above are merely examples of indicators that may be used in accordance with this disclosure and are not meant to constitute an exhaustive list. On the contrary, these illustrative examples are simply intended to provide the reader with a better understanding of the disclosure.

III. Conclusion

The present disclosure is described above and in the accompanying drawings with reference to a variety of example structures, features, elements, and combinations of structures, features, and elements. The purpose served by the disclosure, however, is to provide examples of the various features and concepts related to the disclosure, not to limit the scope of the disclosure. One skilled in the relevant art will recognize that numerous variations and modifications may be made to the embodiments described above without departing from the scope of the present disclosure, as defined by the appended claims. For example, the various features and concepts described above in conjunction with FIGS. 1 through 4 may be used individually and/or in any combination or subcombination without departing from this disclosure.

I claim:

1. A set of iron type golf clubs comprising at least two iron type golf clubs with golf club head bodies wherein each of the golf club head bodies has a different center of gravity and an indicator which indicates the particular center of gravity of the respective golf club head body, and wherein the indicator is a medallion positioned over a cavity in the rear of the golf club head body and includes an opening in the interior of the medallion.

2. A set of iron type golf clubs according to claim 1, wherein the club head bodies with a low degree of loft relative to the set of club head bodies have a center of gravity closer to a hosel of the club head body than the toe of the club head body.

3. A set of iron type golf clubs according to claim 2, wherein the club head bodies with a high degree of loft relative to the set of club head bodies have a center of gravity closer to a toe of the club head body than the heel of the club head body.

4. A set of iron type golf clubs according to claim 3, wherein the club head bodies with a low degree of loft relative to the set of club head bodies have a center of gravity in the lower heel of the club head body.

5. A set of iron type golf clubs according to claim 4, wherein the club head bodies with a high degree of loft relative to the set of club head bodies have a center of gravity in the upper toe of the club head body.

6. A set of iron type golf clubs according to claim 1, wherein the opening moves successively throughout the set of the golf clubs from a position closer to the lower heel for irons with a low degree of loft relative to the set of club head bodies to a position closer to the upper toe for irons with a high degree of loft relative to the set of club head bodies.

7. A set of iron type golf clubs according to claim 6, wherein the indicator includes at least three indicator portions that are positioned over a cavity in the rear of the golf club head body provided in the opening between the indicator portions, further wherein the at least three indicator portions vary in size throughout the set of golf clubs in order to move the opening successively throughout the set of the golf clubs.

8. A set of iron type golf clubs according to claim 1, wherein the indicator includes a material that is heavier than the material of the perimeter weighting member.

* * * * *